US006488527B2

(12) United States Patent
Yoon

(10) Patent No.: US 6,488,527 B2
(45) Date of Patent: Dec. 3, 2002

(54) TERMINAL WITH LINK STRIP

(76) Inventor: Heung-Sik Yoon, #101 Dongkyo Villa, 153-6, Dongkyo-dong, Mapo-ku, Seoul (KR)

( * ) Notice: Subject to any disclaimer, the term of this patent is extended or adjusted under 35 U.S.C. 154(b) by 0 days.

(21) Appl. No.: 09/766,188

(22) Filed: Jan. 18, 2001

(65) Prior Publication Data

US 2001/0027042 A1 Oct. 4, 2001

(30) Foreign Application Priority Data

Jan. 19, 2000 (KR) ..... 00-2429

(51) Int. Cl.[7] ..... H01R 4/24

(52) U.S. Cl. ..... 439/441; 439/715; 439/788; 439/819

(58) Field of Search ..... 439/715, 716, 439/720, 721, 439, 441, 786–788, 819, 828

(56) References Cited

U.S. PATENT DOCUMENTS 5,071,356 A * 12/1991 Strate et al. ..... 439/716
5,322,458 A * 6/1994 Hennemann et al. ..... 439/787
5,334,054 A * 8/1994 Conrad et al. ..... 439/716
5,853,304 A * 12/1998 Landreau et al. ..... 439/716
5,993,245 A * 11/1999 Osada ..... 439/441
6,146,213 A * 11/2000 Yoon ..... 439/716

* cited by examiner

*Primary Examiner*—Hien Vu
(74) *Attorney, Agent, or Firm*—Skjerven Morrill LLP

(57) ABSTRACT

Disclosed is a terminal including at least two terminal bodies each having a plurality of wire receiving holes, and a plurality of hinge shafts rotatably supported by each of the bodies, a plurality of wire connecting engagement members respectively coupled to the hinge shafts so that they are rotated in accordance with the rotation of the hinge shafts, separation walls formed inside of each of the bodies and adapted to limit the rotation of associated ones of the wire connecting engagement members, a link strip adapted to come into contact with wires received in the wire receiving holes, respectively, thereby electrically connecting the wires together, a plurality of springs each arranged between an associated one of the wire connecting engagement members and the body associated with the wire connecting engagement member and adapted to urge the associated wire connecting engagement member toward the link strip, wherein the link strip comprises a plurality of inverted U-shaped bent portions maintained to be in contact with respective outer surfaces of the separation walls, and connecting portions formed integrally with the bent portions and adapted to connect adjacent ones of the bent portions to each other, respectively.

1 Claim, 5 Drawing Sheets

TERMINAL WITH LINK STRIP

BACKGROUND OF THE INVENTION

1. Field of the Invention

The present invention relates to a terminal with a link strip, and more particularly to a terminal which includes a link strip manufactured by simply upwardly and downwardly bending a copper sheet having a strip shape with a desired width.

2. Description of the Related Art

As well known, terminals are configured to receive several strands of conductive wires so that they enable an electrical connection or conduction of those conductive wires. Such terminals are widely used because they have a large conductive current capacity.

Such terminals are used in multiple in such a fashion that a plurality of terminals are laterally laminated together in accordance with a required number of connections. Typically, terminals each having two or four wire receiving holes are mainly used.

Referring to FIG. 1, an example of such terminals is illustrated, which is a four-hole type terminal having four wire receiving holes. As shown in FIG. 1, the terminal includes a body 10, and four loop-shaped wire connecting engagement members 12, 13, 14, and 15 fitted in the body 10. Each wire connecting engagement members 12, 13, 14, or 15 is bent into a b shape to define a hole 12*a*, 13*a*, 14*a*, or 15*a*. The terminal also includes a link strip 20 for electrically connecting the wire connecting engagement members 12, 13, 14, and 15 together.

However, the link strip 20 conventionally used is fabricated by punching a metal sheet into a desired strip shape, and pressing the strip to bend desired portions of he strip in forward, backward, left and right directions, and then bending again the bent portions of the strip. Due to such processes, there is a drawback in that a relatively large amount of blanks are generated after the pressing process. This results in an increased waste of the material, thereby causing an increase in the manufacturing costs. Furthermore, there is a degradation in productivity because the fabrication process used are complex.

Where a plurality of terminals are laterally laminated together, their link strips 20 cannot be connected together. This results in a problem in that it is necessary to individually machine the bodies of the terminals for the connection of the link strips 20.

SUMMARY OF THE INVENTION

Therefore, the present invention has been made to solve the above mentioned problems, and an object of the invention is to provide a terminal which includes a link strip capable of reducing the waste of the material occurring in the fabrication thereof while reducing the number of processing steps involved in the fabrication thereof.

In accordance with the present invention, this object is accomplished by providing A terminal including at least two terminal bodies each having a plurality of wire receiving holes, and a plurality of hinge shafts rotatably supported by each of the bodies, a plurality of wire connecting engagement members respectively coupled to the hinge shafts so that they are rotated in accordance with the rotation of the hinge shafts, separation walls formed inside of each of the bodies and adapted to limit the rotation of associated ones of the wire connecting engagement members, a link strip adapted to come into contact with wires received in the wire receiving holes, respectively, thereby electrically connecting the wires together, a plurality of springs each arranged between an associated one of the wire connecting engagement members and the body associated with the wire connecting engagement member and adapted to urge the associated wire connecting engagement member toward the link strip, wherein the link strip comprises a plurality of inverted U-shaped bent portions maintained to be in contact with respective outer surfaces of the separation walls, and connecting portions formed integrally with the bent portions and adapted to connect adjacent ones of the bent portions to each other, respectively.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, a preferred embodiment of the present invention will be described in detail with reference to the annexed drawings.

Figure 1:
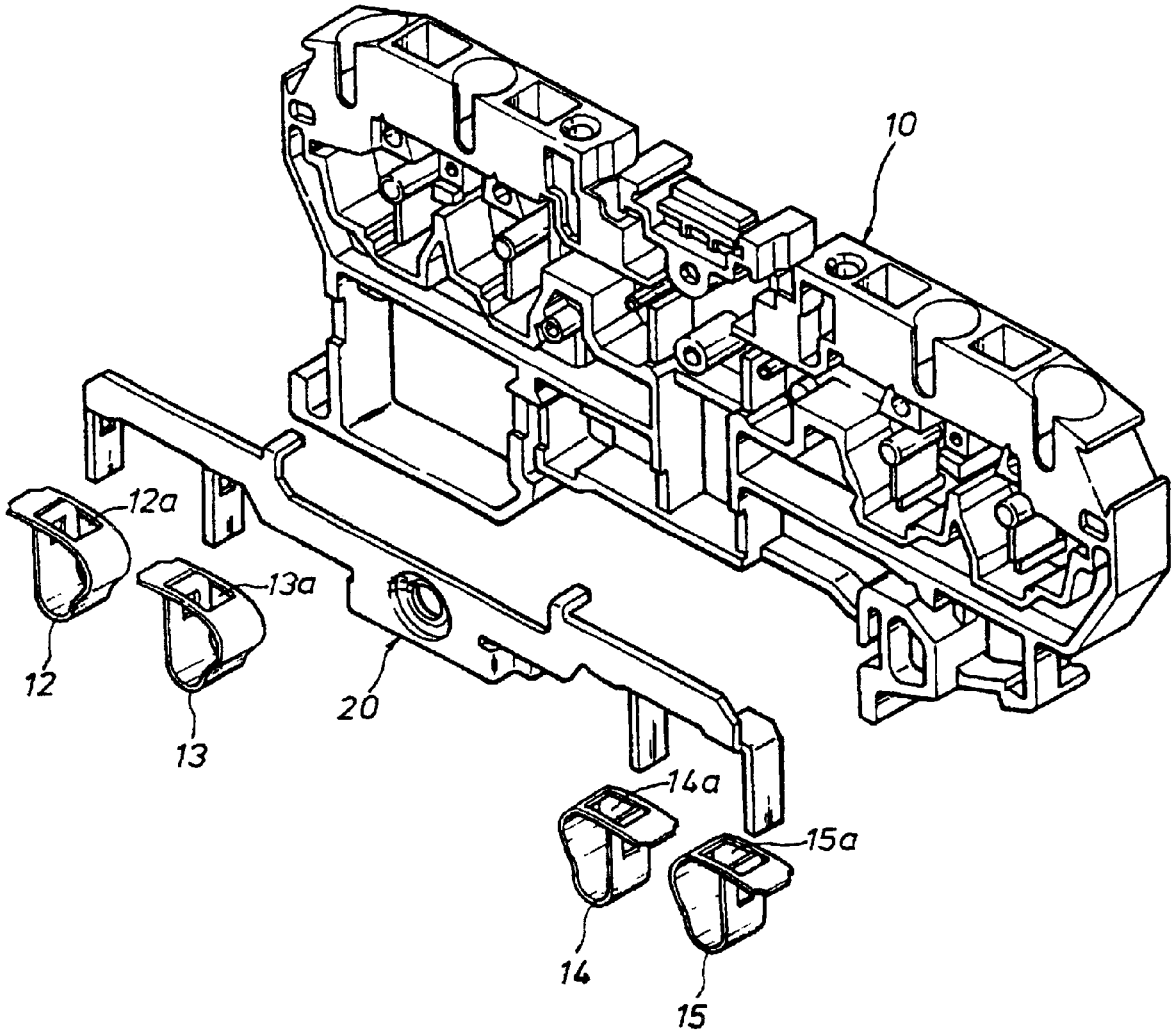
FIG. 1 is a perspective view illustrating a convention four-hole type terminal.
Figure 2:
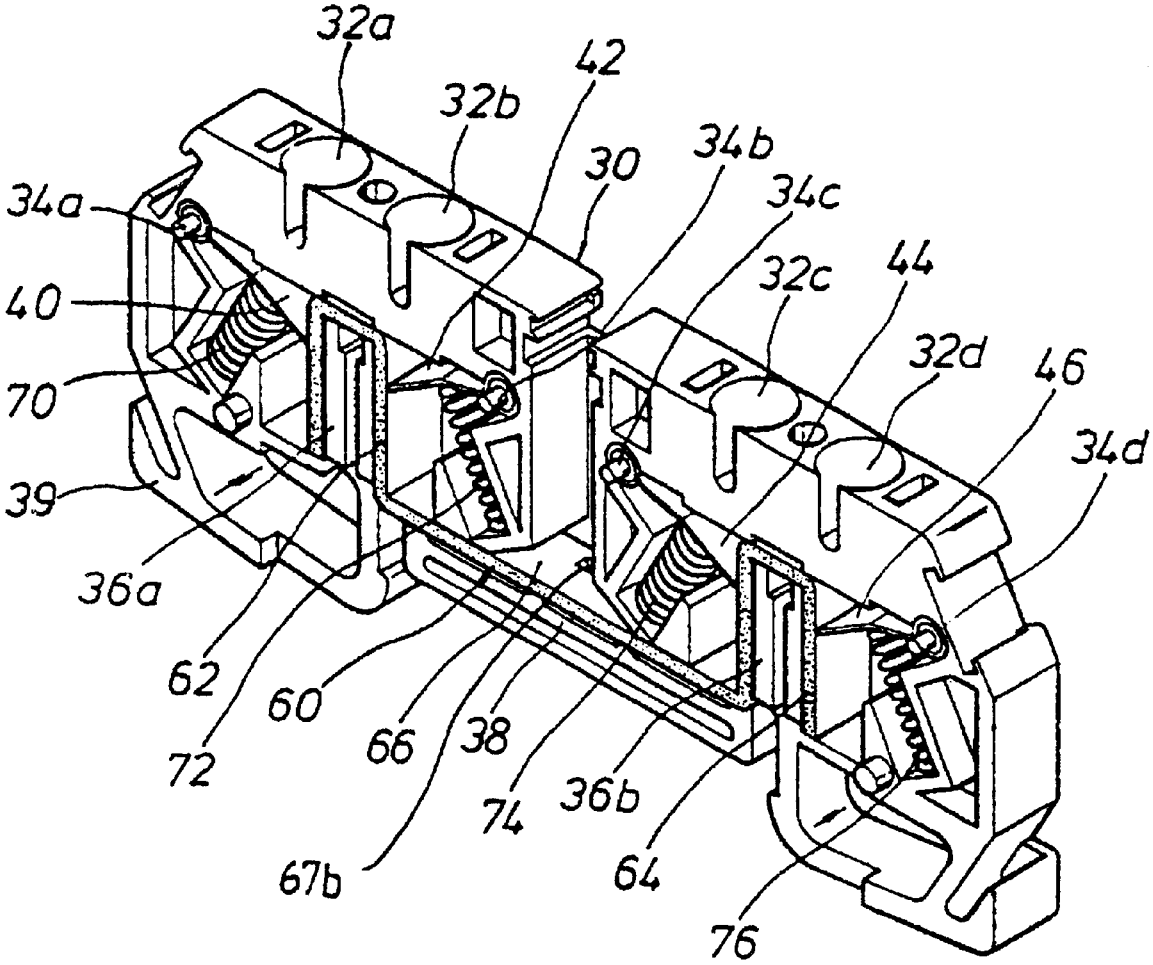
FIG. 2 is a perspective view illustrating a terminal according to the present invention.
Figure 3:
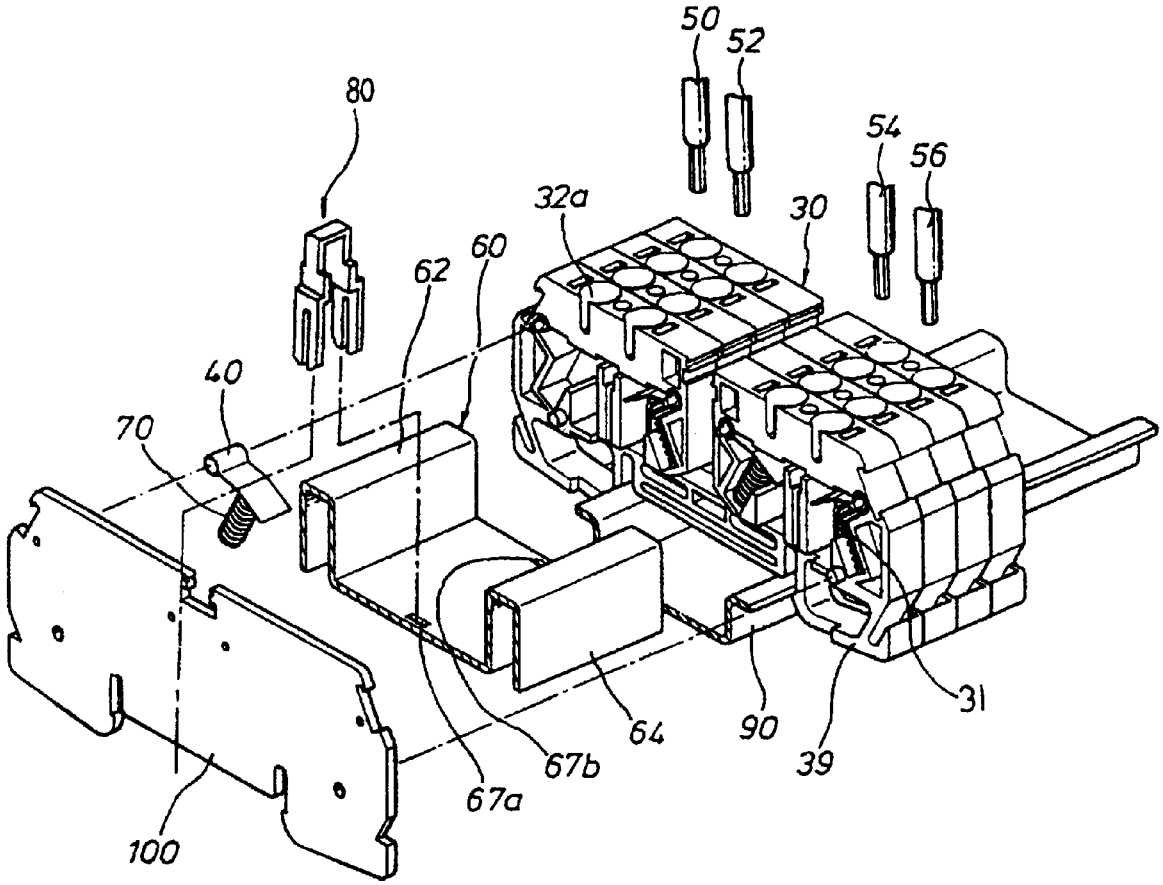
FIG. 3 is an exploded perspective view illustrating a link strip used in the terminal according to the present invention.

Referring to FIGS. 2 and 3, a terminal including a link strip according to an embodiment of the present invention is illustrated, respectively. As shown in FIGS. 2 and 3, the terminal includes a plurality of separate terminal bodies 30. Each terminal body 30 has a plurality of wire receiving holes 32*a*, 32*b*, 32*c*, and 32*d*, and a plurality of hinge shafts 34*a*, 34*b*, 34*c*, and 34*d* rotatably supported by the body. The terminal also includes a pair of separation walls 36*a* and 36*b* formed inside of each body 30, and a plurality of wire connecting engagement members 40, 42, 44, and 46 respectively coupled to the hinge shafts 34*a*, 34*b*, 34*c*, and 34*d* in such a fashion that they are rotated in accordance with the rotation of the hinge shafts 34*a*, 34*b*, 34*c*, and 34*d*. The separation walls 36*a* and 36*b* serve to limit the rotation of associated ones of the wire connecting engagement members 40, 42, 44, and 46. The terminal further includes a link strip 60 adapted to come into contact with wires 50, 52, 54, and 56 received in the wire receiving holes 32*a*, 32*b*, 32*c*, and 32*d*, respectively, a plurality of springs 70, 72, 74, and 76 each arranged between an associated one of the wire connecting engagement members 40, 42, 44, and 46 and the body 30 associated with the associated wire connecting engagement member and adapted to urge the associated wire connecting engagement member 40, 42, 44, or 46 toward the link strip 60. In accordance with the illustrated embodiment of the present invention, the link strip 60 includes U-shaped bent portions 62 and 64 maintained to be in contact with respective outer surfaces of the separation walls 36*a* and 36*b*, and a connecting portion 66 integral with the bent portions 62 and 64 to connect the bent portions 62 and 64 to each other.

Although the terminal is illustrated as having four bodies 30 in FIG. 3, it may have a reduced or increased number of bodies 30. Meanwhile, although the link strip 60 is illustrated as having two bent portions, it may have a plurality of bent portions. In this case, a plurality of connecting portions may be provided, each of which serves to connect adjacent ones of the bent portions to each other.

Slots 67*a* and 67*b* are centrally formed at the connecting portion 66 of the link strip 60. Inverted U-shaped connecting members 80 and 82 are respectively fitted in the slots 67*a* and 67*b* to allow the link strip 60 to be electrically connected to the link strip 60 of a terminal adjacent to the subject terminal in a lamination direction. The body 30 is additionally provided at a central lower portion thereof with a passage 38 allowing the connecting members 80 and 82 to have access to the slots 67*a* and 67*b*.

Each of the bent portions 62 and 64 included in the link strip 60 is bent by a desired angle, for example, 90°. The link strip 60 having the bent portions 62 and 64 is fabricated by subjecting a strip-shaped copper sheet to a forming process.

Also, a rail fitting portion 39 is formed at the lower portion of the body 30 in such a fashion that it is integral with the body 30. A rail 90 is fitted in the rail fitting portion 39.

In the drawings, the reference numeral 100 denotes a cover plate for closing an opened portion of the body 30.

The function and effect of the terminal having the above mentioned configuration according to the illustrated embodiment of the present invention will now be described in detail.

Figure 4:
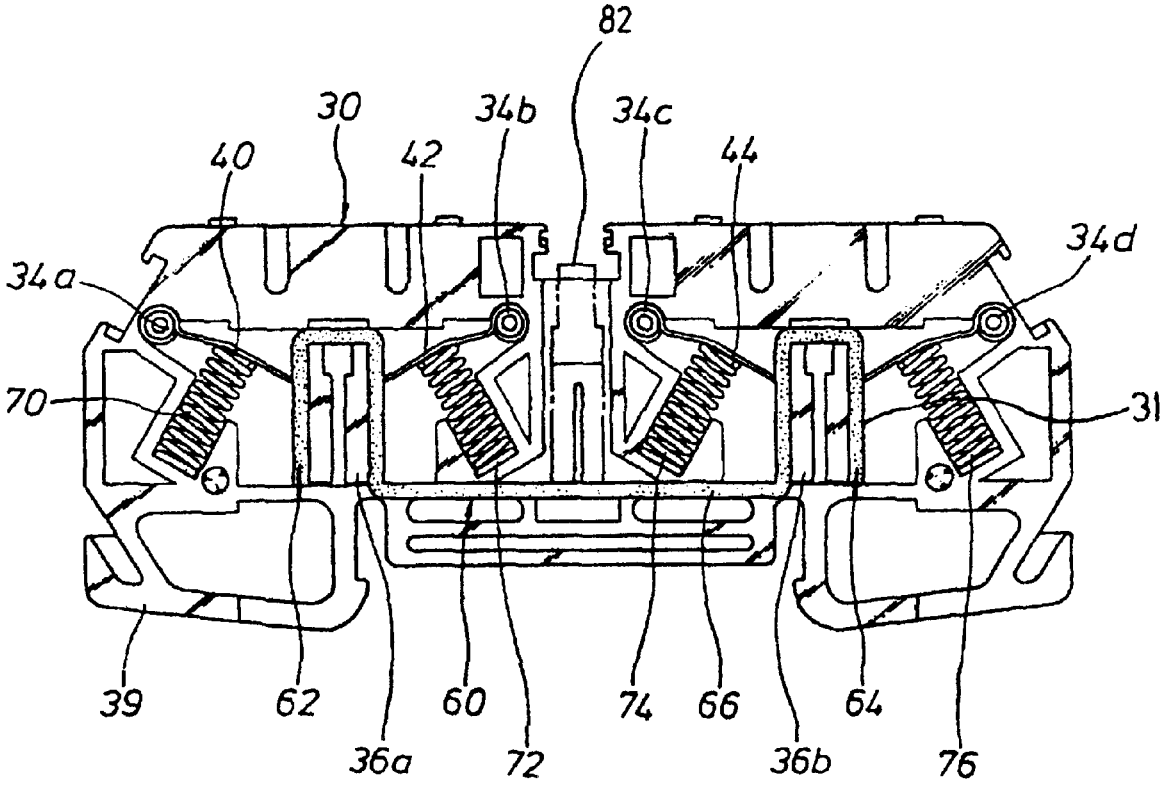
FIG. 4 is a front view illustrating the configuration of the terminal according to the present invention.
Figure 5:
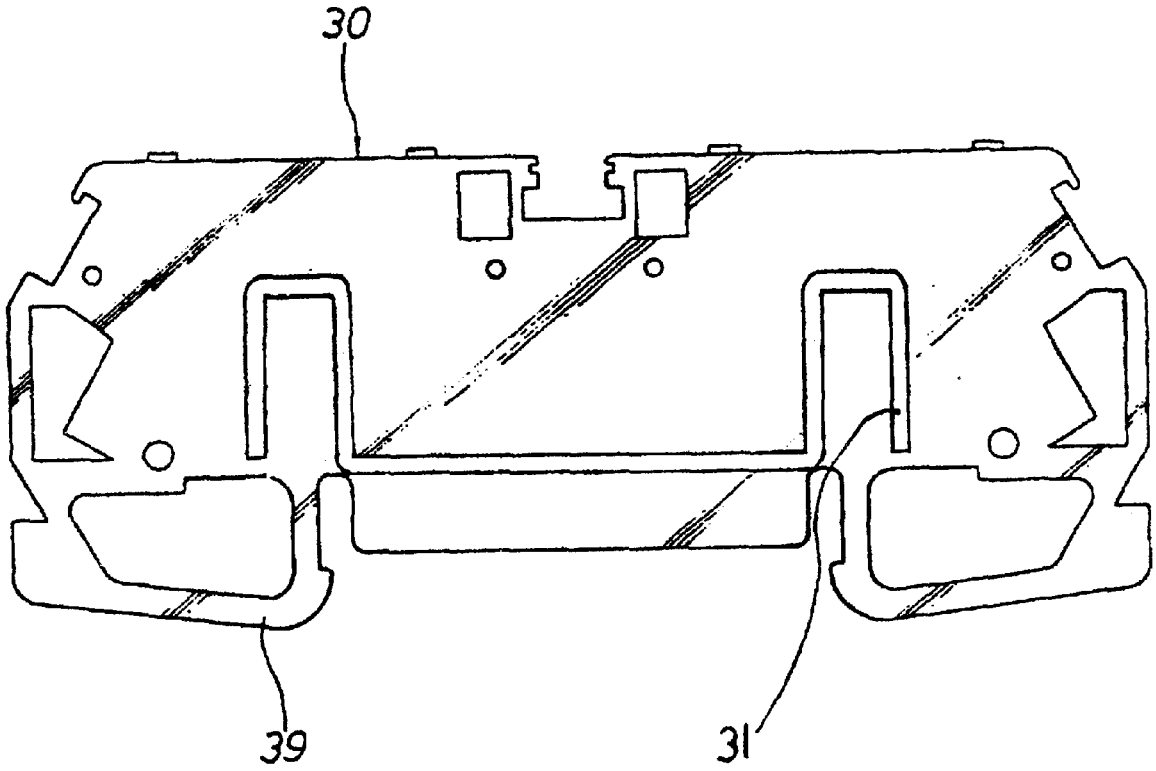
FIG. 5 is a rear view illustrating the terminal according to the present invention.

In order to assemble the link strip 60 with a plurality of terminal bodies 30, the link strip 60 is first inserted into the bodies 30, through penetration hole 31 defined in each body 30, in a state in which the wire connecting engagement members 40, 42, 44, and 46 mounted to each body 30 are depressed. FIGS. 3, 4 and 5 show penetration hole 31, through which link strip 60 passes through each body 30. In accordance with the insertion process, the bent portions 62 and 64 of the link strip 60 come into contact with respective upper and opposite side surfaces of the separation walls 36*a* and 36*b* provided at each body 30, so that they are fitted around the separation walls 36*a* and 36*b*, respectively.

When the pressure applied to the wire connecting engagement members 40, 42, 44, and 46 is released, these wire connecting engagement members 40, 42, 44, and 46 come into contact with the link strip 60 by virtue of the resilience of the springs 70, 72, 74, and 76, respectively. As a result, the wire connecting engagement members 40, 42, 44, and 46 are rendered to be electrically connected together.

Meanwhile, the formation of the link strip 60 is carried out by bending a strip-shaped copper sheet by a right angle using a tool moving simply in upward and downward directions while feeding the copper sheet in a longitudinal direction, and then cutting the bent copper sheet into link strips. By virtue of such a formation process, there is no waste of the material used. Although blanks are generated in the process for punching the link strip 60 to have the slots 67*a* and 67*b* at the central portion thereof, the amount of blanks generated is considerably small, as compared to the conventional case. Thus, the amount of the material used can be greatly reduced.

Where several terminals are used in a laminated state, their link strip 60 can be electrically connected together by fitting the inverted U-shaped connecting members 80 and 82 in the slots 67*a* and 67*b* of adjacent ones of the link strips 60.

As apparent from the above description, in accordance with the present invention, the link strip is fabricated by simply bending a strip-shaped copper sheet in upward and downward directions. Accordingly, the waste of the material generated in the fabrication of the link strip can be considerably reduced. Therefore, it is possible to reduced the manufacturing costs. Also, the fabrication process is simplified, so that a great improvement in productivity is achieved.

What is claimed is:

1. A terminal assembly comprising:

a plurality of terminal bodies each having a plurality of wire receiving holes;

a plurality of rotatable hinge shafts formed into each of said terminal bodies;

wire connecting engagement members coupled to each of said rotatable hinge shafts, said wire connecting engagement members configured to rotate with said rotatable hinge shafts;

separation walls formed inside of each of the bodies and adapted to limit the rotation of the wire connecting engagement members;

a conductive link strip configured to come into contact with wires received in the wire receiving holes thereby electrically connecting the wires together;

a plurality of springs each arranged between an associated one of the wire connecting engagement members and said terminal body associated with the wire connecting engagement member and adapted to urge the corresponding wire connecting engagement member toward the link strip and the corresponding separation wall, said link strip including a plurality of inverted U-shaped bent portions maintained to be in contact with respective outer surfaces of the separation walls, and a connecting portion formed between said plurality of inverted U-shaped bent portions configured to couple said inverted U-shaped bent portions together at a substantially 90° angle;

said link strip having a first length configured to extend simultaneously through a penetration hole defined through said plurality of terminal bodies.

* * * * *